US011105294B2

(12) United States Patent
Knollmayr et al.

(10) Patent No.: US 11,105,294 B2
(45) Date of Patent: Aug. 31, 2021

(54) CYLINDER HEAD FOR AN INTERNAL COMBUSTION ENGINE

(71) Applicant: AVL LIST GMBH, Graz (AT)

(72) Inventors: Christof Knollmayr, Graz (AT); Gerhard Feldhofer, Thal (AT); Robert Grundner, Graz (AT)

(73) Assignee: AVL List GmbH, Graz (AT)

( * ) Notice: Subject to any disclaimer, the term of this patent is extended or adjusted under 35 U.S.C. 154(b) by 0 days.

(21) Appl. No.: 16/487,975

(22) PCT Filed: Feb. 28, 2018

(86) PCT No.: PCT/AT2018/060053
§ 371 (c)(1),
(2) Date: Aug. 22, 2019

(87) PCT Pub. No.: WO2018/157185
PCT Pub. Date: Sep. 7, 2018

(65) Prior Publication Data

US 2020/0248646 A1 Aug. 6, 2020

(30) Foreign Application Priority Data

Mar. 1, 2017 (AT) ..... A 50163/2017

(51) Int. Cl.
*F02F 1/38* (2006.01)
*F01P 3/02* (2006.01)
(Continued)

(52) U.S. Cl.
CPC ..... *F02F 1/38* (2013.01); *F01P 3/02* (2013.01); *F02F 1/243* (2013.01); *F02F 1/40* (2013.01);
(Continued)

(58) Field of Classification Search
CPC ..... F02F 1/38; F02F 1/40; F02F 1/243; F01P 3/02; F01P 2060/16; F01P 2003/024; F01P 2003/027; F01P 2003/028
See application file for complete search history.

(56) References Cited

U.S. PATENT DOCUMENTS 5,217,059 A * 6/1993 Kuhn ..... B22C 9/10 123/195 R
2010/0242869 A1* 9/2010 Knollmayr ..... F01P 3/02 123/41.82 R
(Continued)

FOREIGN PATENT DOCUMENTS

DE 102013221215 A1 10/2013
EP 2388463 B1 5/2012
(Continued)

*Primary Examiner* — Jacob M Amick
*Assistant Examiner* — Charles J Brauch
(74) *Attorney, Agent, or Firm* — Dykema Gossett PLLC

(57) ABSTRACT

A cylinder head of an internal combustion engine, comprising at least one cylinder, a cooling jacket arrangement with a first cooling jacket arranged in the region of a longitudinal central plane of the cylinder head, a second cooling jacket facing a fire deck of the cylinder head, and a third cooling jacket facing away from the fire deck, wherein the first cooling jacket and the second cooling jacket are flow connected to the third cooling jacket via at least one first transfer section and at least one second transfer section respectively.

19 Claims, 7 Drawing Sheets

(51) Int. Cl.
*F02F 1/24* (2006.01)
*F02F 1/40* (2006.01)

(52) U.S. Cl.
CPC ... *F01P 2003/024* (2013.01); *F01P 2003/027* (2013.01); *F01P 2003/028* (2013.01); *F01P 2060/16* (2013.01)

(56) References Cited

U.S. PATENT DOCUMENTS

| | | | |
|---|---|---|---|
| 2012/0012073 | A1 | 1/2012 | Brewer et al. |
| 2016/0186641 | A1 | 6/2016 | Ogino et al. |

FOREIGN PATENT DOCUMENTS

| | | | | |
|---|---|---|---|---|
| EP | 2500558 | B1 * | 9/2012 | ..... F02F 1/243 |
| EP | 2500558 | B1 | 2/2017 | |
| JP | 2011127499 | A | 6/2011 | |
| JP | 2016044572 | A | 4/2016 | |

* cited by examiner

CYLINDER HEAD FOR AN INTERNAL COMBUSTION ENGINE

CROSS-REFERENCE TO RELATED APPLICATIONS

This application is a national stage filing based upon International PCT Application No. PCT/AT2018/060053, filed 28 Feb. 2018, which claims the benefit of priority to Austria application No. A 50163/2017, filed 1 Mar. 2017.

BACKGROUND

The invention relates to a cylinder head for an internal combustion engine, comprising at least one cylinder, wherein the cylinder head has a cooling jacket arrangement with a first cooling jacket, a second cooling jacket and a third cooling jacket, wherein the first cooling jacket is arranged in the region of a longitudinal central plane of the cylinder head, and the second cooling jacket adjoins an underside, facing a fire deck of the cylinder head, of an exhaust manifold integrated into the cylinder head on an outlet side, and wherein the third cooling jacket is adjacent to an upper side, facing away from the fire deck, of the exhaust manifold, wherein the second cooling jacket of the cylinder head is flow-connectable via at least one second inlet opening in the fire deck to at least one cooling chamber of a cylinder block connectable to the cylinder head.

It is known that in cooling arrangements of liquid-cooled cylinder heads the longitudinal and transverse inflow components are combined in order to optimize flow directions and flow velocities. The disadvantage is that this is generally associated with an increase in the overall size.

From DE 10 2013 221 215 A1 a water jacket structure for a cylinder head is known which comprises an inlet water jacket for cooling the inlet openings, a combustion chamber water jacket for cooling an upper combustion chamber section and an outlet water jacket with a lower and an upper outlet water jacket for cooling the outlet openings and an integrated outlet manifold. The inlet water jacket is connected to a water jacket on the block side and the combustion chamber water jacket. The combustion chamber water jacket is connected to the block-side water jacket and the upper outlet water jacket. The lower outlet water jacket is connected to the block-side water jacket. The lower outlet water jacket is not connected to the inlet water jacket, the combustion chamber water jacket and the upper outlet water jacket. Thus the lower outlet water jacket and the upper outlet water jacket within the cylinder head form independent flow channels with flow in the longitudinal direction. The coolant is discharged from the lower and upper outlet water jackets separately at one end face of the cylinder head.

EP 2 500 558 A1 describes a cylinder head with lower and upper cooling jackets arranged on the exhaust side, which border on the exhaust manifold and are flow-connected, wherein a middle cooling jacket is flow-connected to the lower cooling jacket. The three cooling jackets are positioned so that the entire coolant from the cylinder block is first guided into the lower cooling jacket and then into the other two cooling jackets. The coolant is discharged via the cylinder head. The coolant is thus successively heated and can absorb less and less heat, which leads to a reduced overall cooling effect.

Furthermore, a cylinder head for an internal combustion engine with a water jacket is known from JP 2016-044572

A, which is designed as a single continuous cooling chamber comprising three cooling channels connected to each other via a connecting channel.

SUMMARY OF THE INVENTION

It is the object of the invention to enable efficient cooling of a cylinder head that is as compact as possible with as little effort as possible. In particular, all critical areas of the cylinder head, including the integrated exhaust manifold, should be optimally cooled.

This object is solved with an initially mentioned cylinder head according to the invention in that the first cooling jacket can be flow-connected to the cooling chamber of the cylinder block via at least one first inlet opening, and in that the first cooling jacket is flow-connected to the third cooling jacket via at least one first transfer section and the second cooling jacket is flow-connected to the third cooling jacket via at least one second transfer section.

The term "cooling jacket" here refers to a continuous cooling chamber whose walls are designed to dissipate the heat from thermally critical areas of the cylinder head over a large area and thus to cool it. The term "transfer sections" refers to flow connections without a significant cooling function between cooling jackets, which are mainly used to transport the liquid cooling medium between the cooling jackets. The flow rate and velocity of the cooling medium can be influenced by dimensioning the cross sections of the transfer sections.

Thus, the first cooling jacket and second cooling jacket of the cylinder head can be supplied with inflow independently of each other from the cooling chamber of the cylinder block. Due to the separate inflow of the first and second cooling jackets, these are decoupled from each other in terms of flow technology, wherein a quantity of liquid, flow direction and/or flow velocity in the two cooling jackets can be set independently of each other. As a result, the cylinder head can be cooled more efficiently.

Furthermore, the flow directions and/or flow quantities in the third cooling jacket can be efficiently controlled by the first and second transfer sections between the first cooling jacket and the third cooling jacket on the one hand and between the second cooling jacket and the third cooling jacket on the other hand. This allows the temperature gradient and/or flow rate and/or amount of coolant to be adjusted so that all parts of the cylinder head are cooled efficiently.

In one variant of the invention, the first inlet opening and/or the second inlet opening are located on the outlet side of the cylinder head. This allows effective cooling of the hottest areas and the temperature gradient to be specifically influenced. In addition, an optimum coolant supply direction is possible.

One embodiment of the invention provides that the first cooling jacket adjoins the fire or combustion chamber deck. This enables effective heat dissipation from the area of the combustion chamber deck, i.e. the wall area of the cylinder head directly adjacent to the combustion chambers of the cylinders, where the thermal loads are particularly high.

It is provided in a further embodiment of the invention that the third cooling jacket is separated from the first and second cooling jackets by an intermediate deck. This makes it possible to increase the strength in the cylinder head and reduce the thermal expansion in the cylinder head.

It is provided in one embodiment of the invention that the first and/or the third cooling jacket can be flow-connected to the cooling jacket of the cylinder block via in each case at least one outlet opening arranged on the inlet side. The outlet openings from the first and third cooling jackets are thus arranged in such a way that the coolant can be returned to the cylinder block, especially on the inlet side. This coolant guidance essentially eliminates longitudinal inflow parts and a cross-flow of the coolant is used in all cooling jackets. As a result, the size of the cylinder head can be reduced considerably. However, in combination with the above mentioned design and arrangement or connection between the cooling jackets, the temperature gradient, the flow velocity and the coolant quantity can still be adjusted so that all parts can be cooled efficiently.

It is provided in one variant of the invention that the third cooling jacket can be connected to the vehicle heater via at least one transfer section opening. On the one hand, a flow direction and velocity of the liquid coolant in the third cooling jacket are specified, and on the other hand, the integrated exhaust manifold of the cylinder head in the area of the exhaust flange is also flowed around and cooled. Preferably it is provided in this case that the third cooling jacket has at least one projection in the area of the transfer section opening in order to be able to cool a connected charger and its screws. This prevents the screws from loosening due to temperature.

The cooling jackets can be formed with recesses or with cavities that are as small as possible in order to reduce the amount of coolant required and to be able to influence a temperature gradient better.

It is provided in a further variant of the invention that the third cooling jacket extends from an outlet side of the cylinder head in the direction of an inlet side of the cylinder head to at least one intermediate cylinder region. This means that the area of the cylinder head in the area of transverse planes—normally formed on the longitudinal central plane—between two cylinders can also be effectively cooled.

It is also advantageous if the first cooling jacket flows—at least partially—around at least one outlet valve seat area as well as at least one central area of at least one cylinder. A central area here is understood in particular as the area within the outer circumference of the cylinder near the cylinder axis. This is preferably achieved in that the first cooling jacket has a channel ring in at least one central region of at least one cylinder, which channel ring is preferably arranged concentrically to the cylinder axis thereof.

In order to effectively cool the exhaust valve seat region, it is advantageous if the first cooling jacket has at least one radial channel and/or a channel bridge adjoining at least one exhaust valve seat region, wherein preferably the radial channel or the channel bridge proceed from a channel ring arranged in at least one central region of a cylinder. This makes it possible to effectively cool the known hot areas around the exhaust valve seats and in the center of the cylinder. The first cooling jacket is thus designed in such a way that flow is forced around both the outlet valve seats and the central area.

In order to effectively protect elements such as seals from overheating, it is advantageous if the second cooling jacket extends from an edge area of the cylinder to the outlet flange area, which allows a temperature in the outlet flange area to be lowered to at least below 205° C.

At least one first and/or at least one second transfer section can be formed by a bore with a defined diameter. The size of the bores can influence the coolant quantity or coolant speed and thus be defined. Alternatively or in addition thereto, it may be provided that a limiting element is arranged in the cooling chamber of the cylinder block, in the region of at least one first and/or second inlet opening of the fire deck and/or in the region of at least one outlet opening, in order to determine the quantity of the coolant flow. The limiting element can be formed by a separate insert built into the coolant flow path or by a co-cast cross-sectional constriction, bulge of the cylinder head or cylinder block. This allows the coolant quantity to be controlled in such a way that directional cooling is possible.

In order to keep the pressure loss in the overall system as small as possible, it is advantageous if the first, second and/or third cooling jacket have different flow cross-sections. The individual flow cross-sections are adapted to the respective cooling requirements.

Further advantages in terms of manufacturing costs and manageability in production arise when the first and second cooling chambers are produced by a common integral casting core.

The object of the invention is also solved by an internal combustion engine with a cylinder head as described above.

In order to efficiently cool the cylinder head with integrated exhaust manifold, it is advisable to reduce the amount of coolant used so that the engine can be heated quickly on the one hand, a desired temperature gradient can be better influenced on the other hand, and the flow velocities of the coolant can further be increased.

The cooling jacket arrangement of the cylinder head according to the invention is therefore three-part, wherein two lower cooling jackets (the first and second cooling jackets) and one upper cooling jacket (the third cooling jacket) are provided. The lower cooling jackets in the cylinder head can be flowed into separately from each other from the cooling chamber of the cylinder block or are flowed into independently from each other or are flow-decoupled from each other, whereby the cooling quantity, flow direction and/or flow velocity of the coolant in the two lower cooling jackets can be adjusted independently from each other.

The first cooling jacket is designed in such a way that the flow is forced around both exhaust valve seats and a central spark plug or the injector seat of a central injection device. In order to avoid knocking in the intermediate cylinder area, the upper, i.e. third, cooling jacket is designed in such a way that the intermediate cylinder area is also cooled by it. The two lower first and second cooling jackets include inlets, outlets and transfer sections for coolants. The second cooling jacket, which is arranged in the same plane as the first cooling jacket, comprises several recesses to reduce the amount of coolant and thereby achieve higher flow velocities. It is also designed to reduce a temperature in the outlet flange area to below 250° C., especially below 220° C., to protect its elements such as gaskets from overheating.

Both lower (i.e. first and second) cooling jackets have several transfer sections to the upper third cooling jacket. The upper third coolant jacket has several recesses to allow guidance of coolant and to avoid large cavities, resulting in greater stability and strength of the cylinder head. The transfer sections between the cooling jackets are designed as openings, such as bores in seals, wherein the coolant quantity or flow velocity of the coolant can be controlled via the size of the bores.

In order to specify a flow direction and/or flow velocity of the coolant in the upper third cooling jacket, a transfer section opening is provided from the third cooling jacket to the vehicle heater, whereby the exhaust manifold outlet flange is also flowed around or cooled. On both sides of the transfer section opening to the vehicle heater, the shape of the third cooling jacket is designed in such a way that the fastening screws of the subsequent charger are flushed around so that thermally caused loosening of the fastening screws is avoided.

BRIEF DESCRIPTION OF THE DRAWINGS

The invention is explained in detail below using a non-restrictive embodiment example shown in the figures, which schematically show as follows.

DETAILED DESCRIPTION

Figure 1:
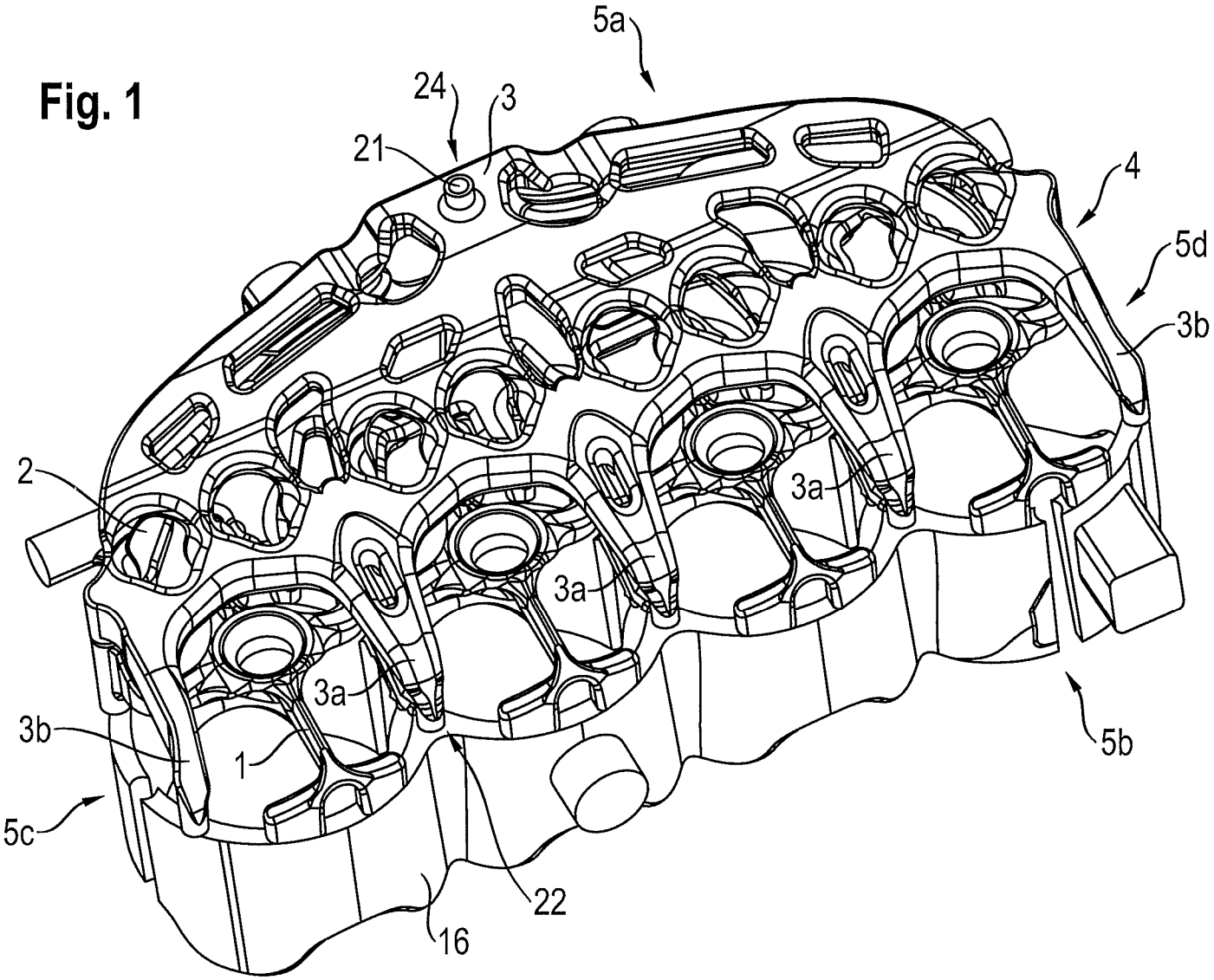
FIG. 1 shows a cooling jacket arrangement according to the invention in an oblique view.

FIGS. 1 to 7 show a three-part cooling jacket arrangement 4 for a cylinder head 5 of an internal combustion engine with several cylinders 6, which coolant arrangement 4 comprises a first cooling jacket 1, a second cooling jacket 2 and a third cooling jacket 3.

Figure 8:
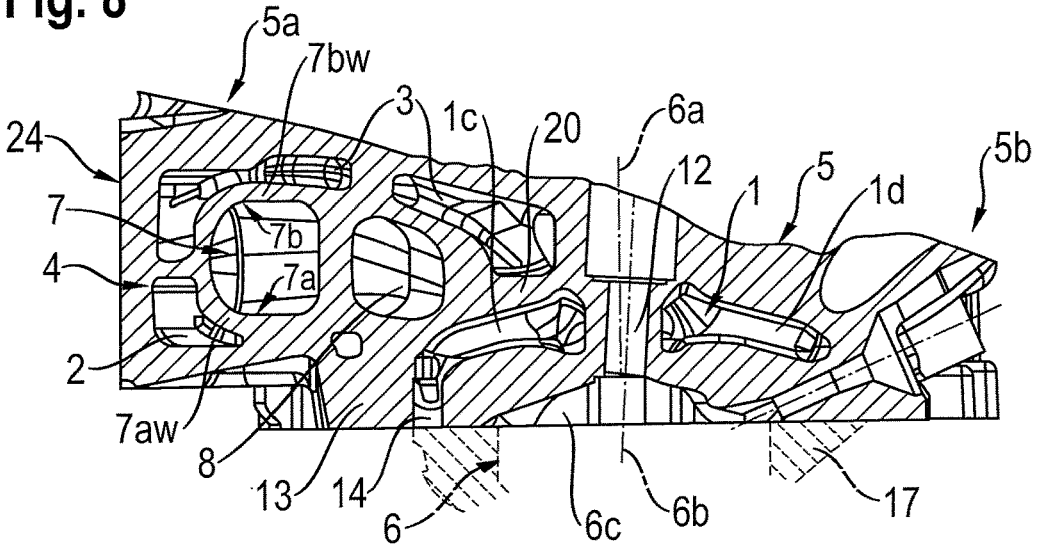
FIG. 8 shows a cylinder head according to the invention, comprising a cooling jacket arrangement according to the invention in a first section transverse to its longitudinal central plane.
Figure 9:
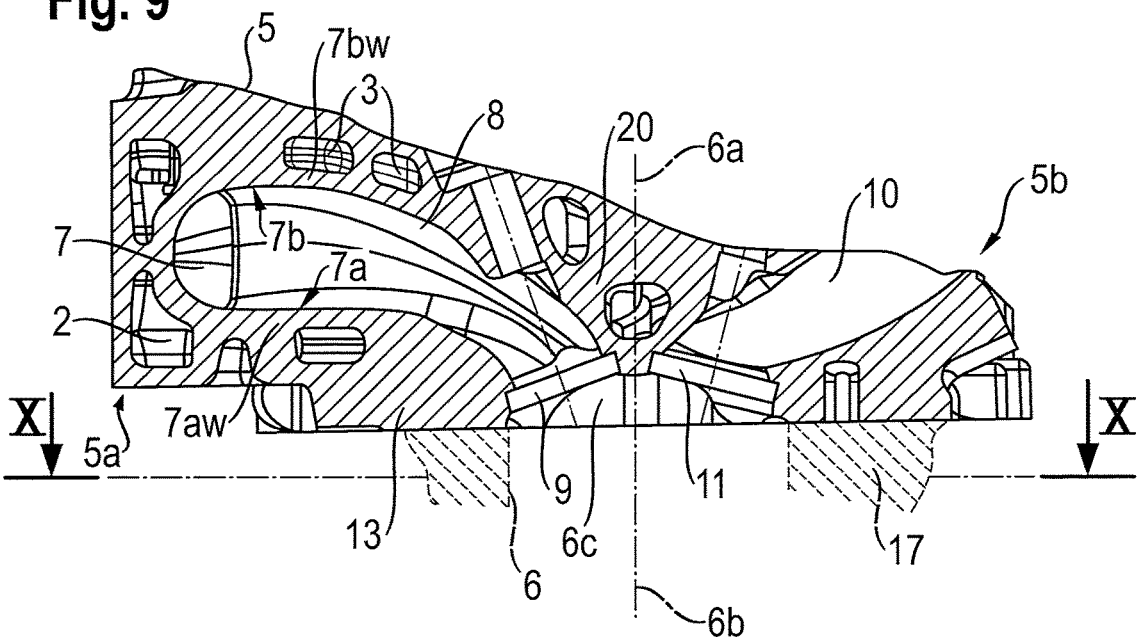
FIG. 9 shows the cylinder head from FIG. 8 in a second section transversely to its longitudinal central plane.

The first cooling jacket 1 adjoining the combustion chamber or fire deck 13 (or the cylinder head base) of the cylinder head 5 is arranged in the region of a longitudinal central plane 6*b* of the cylinder head 5 separating an outlet side 5*a* and an inlet side 5*b*, which is clamped by the cylinder axes 6*a* of the cylinder 6. The cylinder head 5 has an integrated exhaust manifold 7 on the exhaust side 5*a*, as shown in FIG. 8 and FIG. 9. Furthermore, the cylinder head 5 has two exhaust valve openings 9 for two exhaust ducts 8 leading to the integrated exhaust manifold 7 and two intake valve openings 11 for two intake ducts 10 arranged on the inlet side 5*b* on the exhaust side 5*a* per cylinder 6. In addition, the cylinder head 5 has per cylinder 6 a central opening 12 in the fire deck 13 in the area of the cylinder axis 6*a* for a component opening into the combustion chamber 6*c* of a cylinder 6, for example an injection device or a spark plug.

The second cooling jacket 2 of the cooling jacket arrangement 4 is arranged between the fire deck 13 of the cylinder head 5 and the underside 7*a* of the exhaust manifold 7 facing the fire deck 13. The third cooling jacket 3 is arranged in the area of an upper side 7*b* of the exhaust manifold 7 facing away from the fire deck 13. The second cooling jacket 2 and the third cooling jacket 3 connect directly to the exhaust manifold 7 and are separated from it only by the duct walls 7*aw* or 7*bw* on the underside 7*a* or upper side 7*b* (FIG. 8 and FIG. 9). The flow cross-sections of the first 1, second 2 and third cooling jackets 3 can be dimensioned differently. The first cooling jacket 1 and the second cooling jacket 2 can be produced by a common casting core.

In the fire deck 13 of the cylinder head 5, first inlet openings 14 and second inlet openings 15 for coolant are arranged in the area of the outlet side 5*a*. The first inlet openings 14 are connected to the first cooling jacket 1, the second inlet openings 15 to the second cooling jacket 2. Via these first inlet openings 14 and second inlet openings 15, the first cooling jacket 1 or second cooling jacket 2 can be connected to cooling chambers 16 of a cylinder block indicated in FIG. 10 with reference numeral 17, which is attached to the cylinder head base 13 of the cylinder head 5. The coolant flows into the cooling jackets 1, 2, 3 can be adjusted by means of dimensioning the cross-sections of the inlet openings 14, 15 and/or passages corresponding thereto in an adjoining cylinder head gasket (not shown further).

The first cooling jacket 1 and the second cooling jacket 2 are separated from the third cooling jacket 3 by an intermediate deck 20. However, the third cooling jacket 3 is connected to the first cooling jacket 1 via at least one first transfer section 18 and to the second cooling jacket 2 via at least one second transfer section 19. The transfer sections 18, 19 extend, for example, in the intermediate deck 20 and have a defined flow cross-section.

The third cooling jacket 3 can be flow-connected via at least one transfer section opening 21—which is positioned in FIG. 1, FIG. 3, FIG. 4, FIG. 6 and FIG. 7, for example, at the highest point of the third cooling jacket 3—to a vehicle radiator for heating the interior of the vehicle, which is not shown further, said transfer section opening 21 being arranged in the region of a transverse central plane 23*b* of the cylinder head extending normally to the longitudinal central plane 6*b* and parallel to the cylinder axes 6*a*.

In order to optimally cool thermally critical areas between the cylinders 6, the embodiment example shows the third cooling jacket 3 extending from the upper side 7*b* of the exhaust manifold 7 via finger-like first channel extensions 3*a* to an intermediate cylinder area 22, in particular on both sides of an intermediate transverse plane 23*c* between two adjacent cylinders 6. The intermediate transverse plane 23*c* is arranged normally to the longitudinal central plane 6*b* of the cylinder head 5 and parallel to the cylinder axes 6*a* (FIG. 3, FIG. 4) or extends parallel to the cylinder head transverse central plane 23*b* or coincides with it.

Also in the area of the end faces 5*c*, 5*d* of the cylinder head 5, the third cooling jacket has 3 finger-like second channel extensions 3*b* with a smaller cross-section than the first channel extensions 3*a*. Of these second channel extensions 3*b*, the one shown in FIG. 4 on the first end face 5*c* serves to supply the coolant from the cooling chambers 16 of the cylinder block 17 via a third inlet opening 27 to the third cooling jacket 3.

Figure 2:
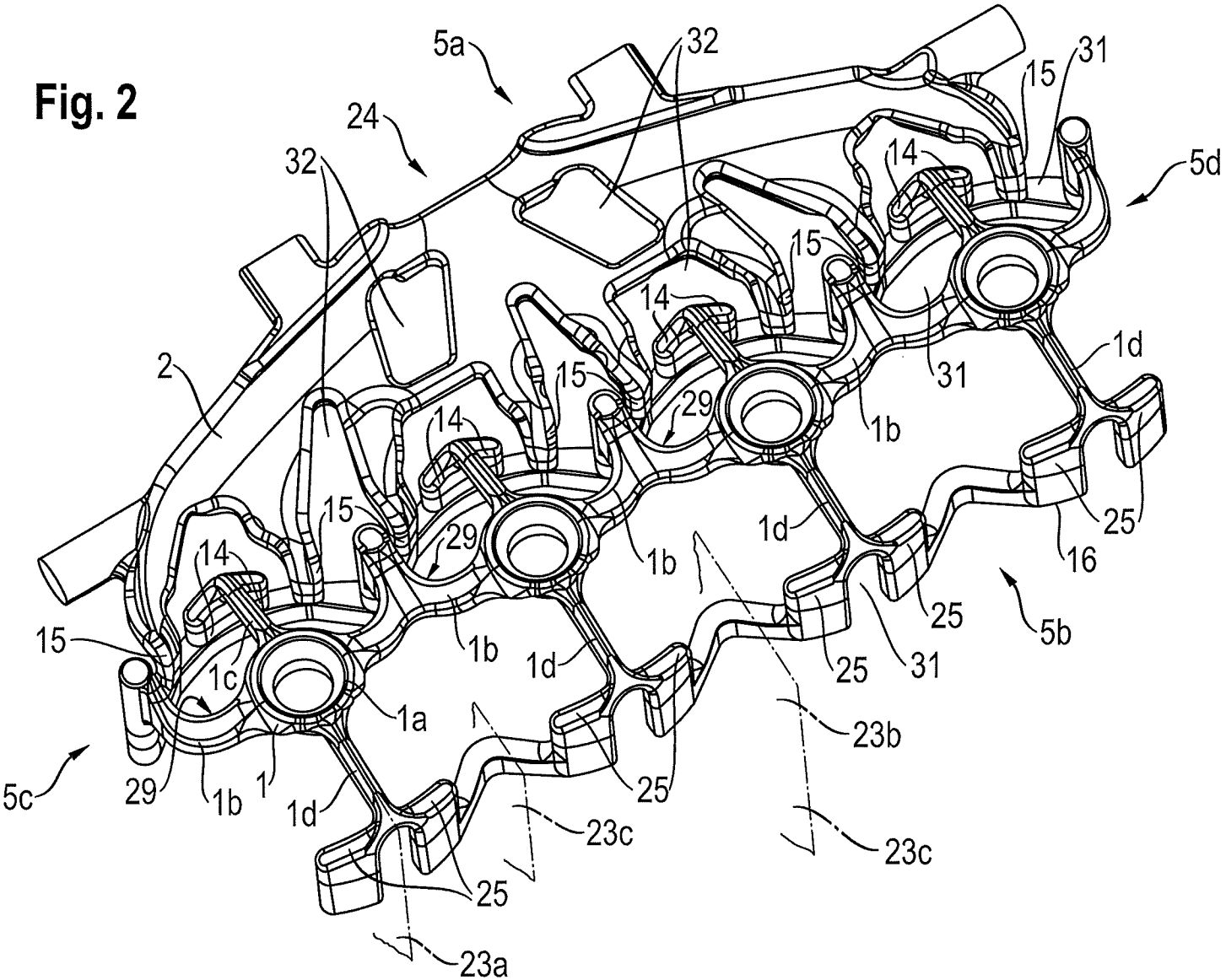
FIG. 2 shows a first and a second cooling jacket of the cooling jacket arrangement in an oblique view.
Figure 3:
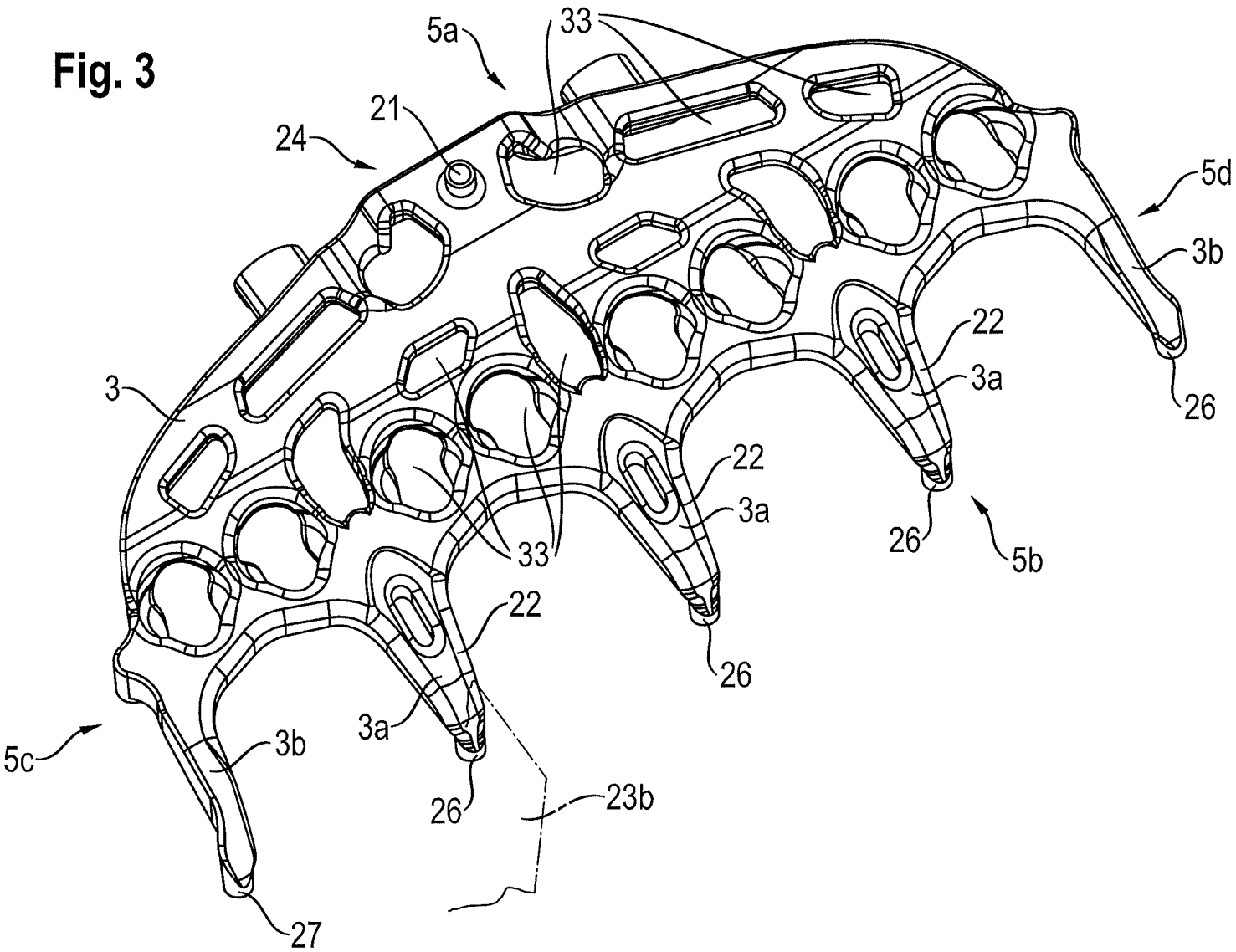
FIG. 3 shows a third cooling jacket of the cooling jacket arrangement in an oblique view.
Figure 5:
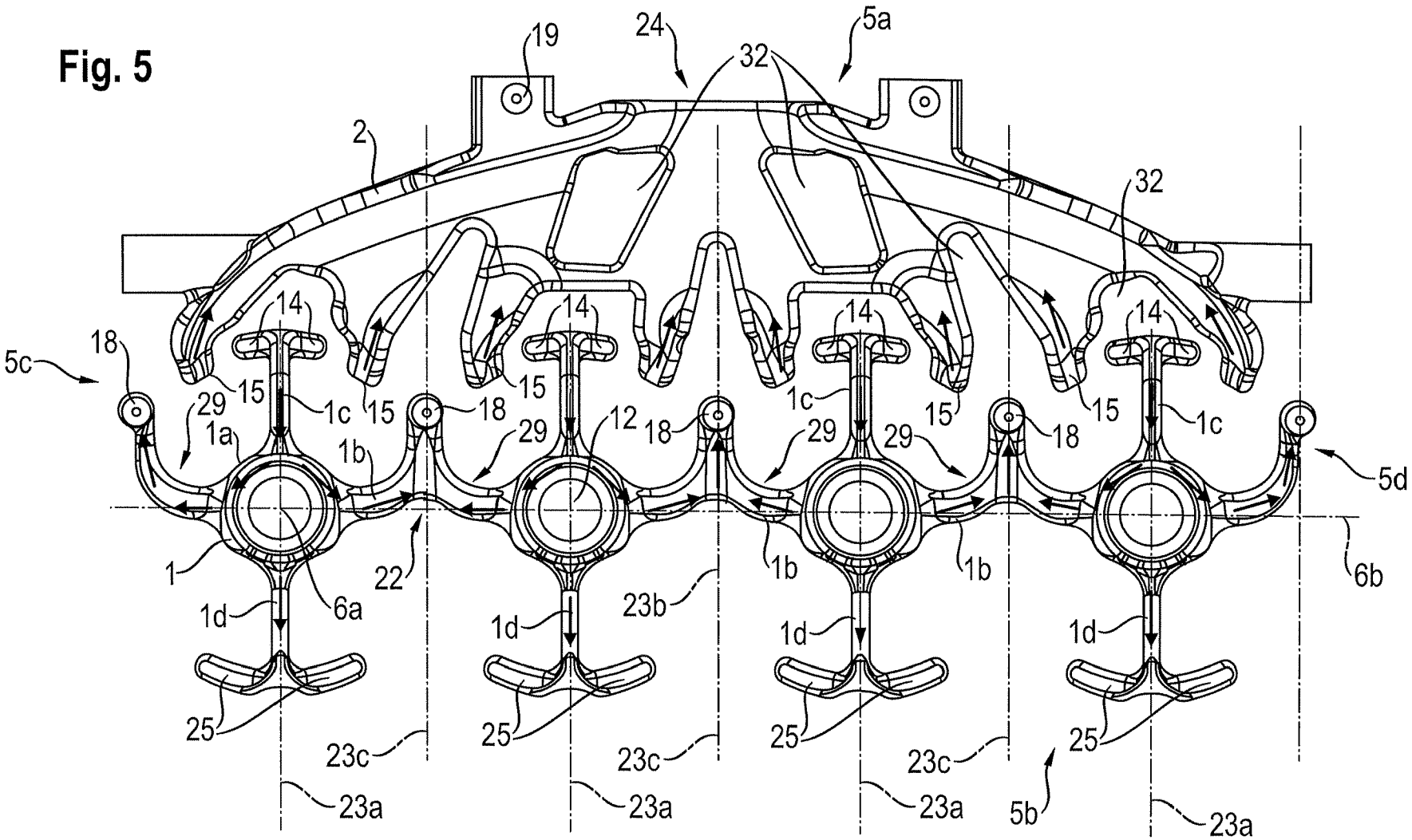
FIG. 5 shows the first and second cooling jackets of the cooling jacket arrangement in a plan view.

The first cooling jacket 1 surrounds the central opening 12 in a central channel ring 1*a* per cylinder 6 so that this hot area is cooled particularly well. The central channel rings 1*a* of adjacent cylinders 6 are connected to each other via channel bridges 1*b* extending in the longitudinal direction of the cylinder head 5, i.e. essentially parallel to the longitudinal central plane 6*b* (FIG. 2, FIG. 5). Furthermore, the central channel rings 1*a* are connected to the first inlet openings 14 via radial channels 1*c* on the outlet side and to the first outlet openings 25 via radial channels 1*d* on the inlet side (FIG. 5). The channel bridges 1*b* and the radial channels 1*c* on the outlet side are formed adjacent to the outlet valve seat areas 29.

The second cooling jacket 2 extends from cylinder 6 to an outlet flange area 24.

The first cooling jacket 1 is flow-connected to the cooling chamber 16 of the cylinder block 17 via first outlet openings 25 and the third cooling jacket 3 is flow-connected to the cooling chamber 16 of the cylinder block 17 via third outlet openings 26, wherein the outlet openings 25 and 26 are each arranged on the inlet side 5*b* of the cylinder head 5. The first outlet openings 25 are arranged on both sides of a cylinder central transverse plane 23*a* extending normally to the longitudinal central plane 6*b* and through the cylinder axis 6*a* (FIG. 2, FIG. 4).

Figure 4:
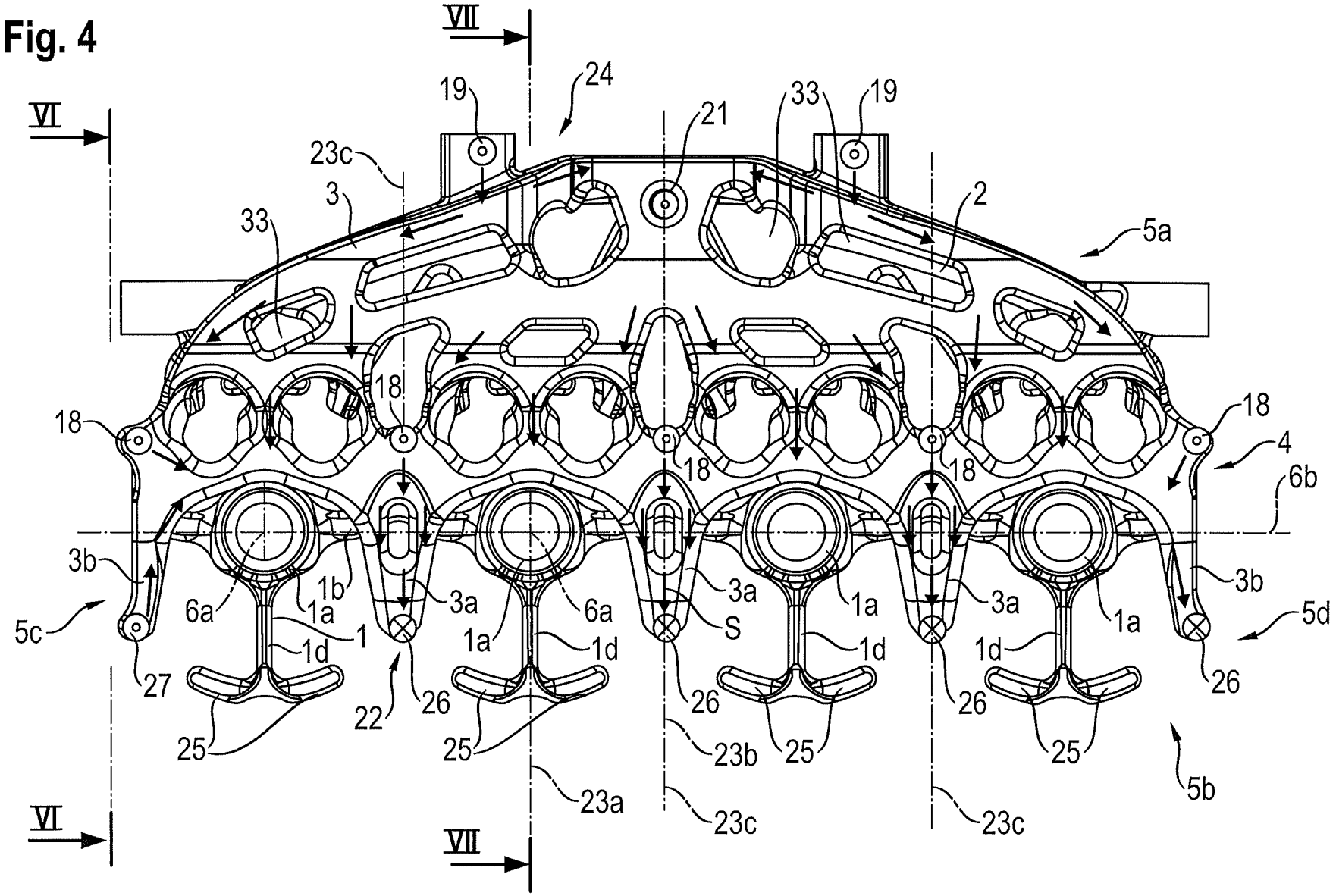
FIG. 4 shows the cooling jacket arrangement in a plan view.
Figure 6:
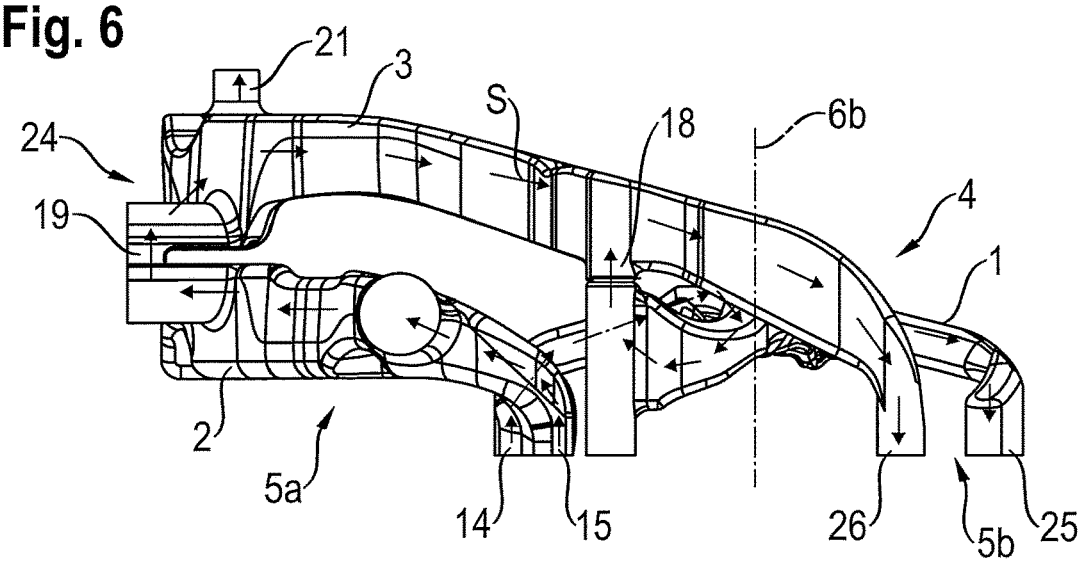
FIG. 6 shows the cooling jacket arrangement in a side view according to line VI-VI in FIG. 4.
Figure 7:
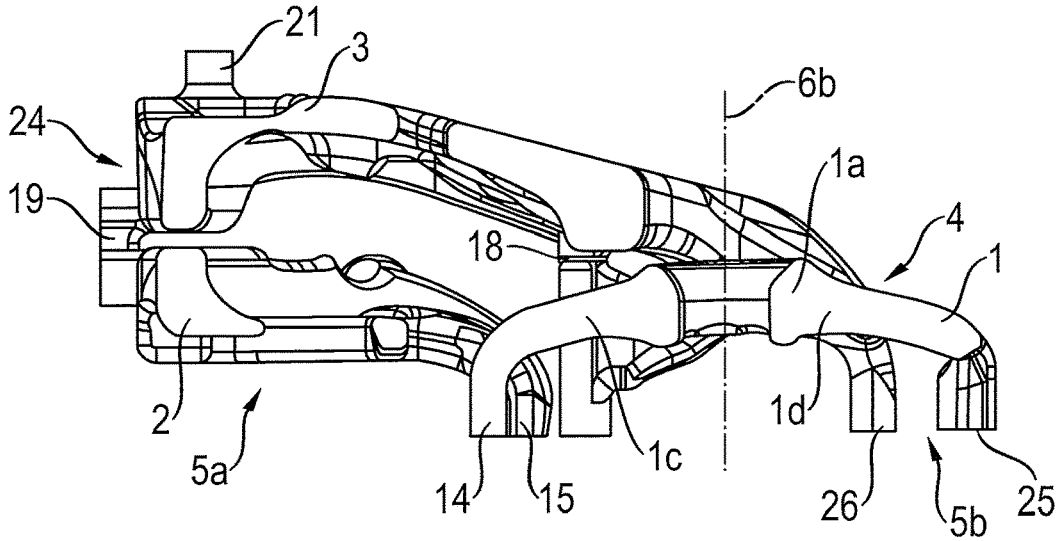
FIG. 7 shows the cooling jacket arrangement in a section according to line VII-VII in FIG. 4.

In FIG. 4 to FIG. 6, arrows S indicate the flow directions of the coolant in cooling jackets 1, 2 and 3. In addition, first transfer sections 18 and second transfer sections 19, the transfer section opening 21 and the inlet openings 14, 15 are shown. The drawings also show that an intermediate deck 20 is provided between the lower first cooling jacket 1 and the upper third cooling jacket 3. The intermediate deck 20 increases the strength and rigidity of the cylinder head 5 and reduces thermal expansion. Furthermore, the additional intermediate deck 20 has the advantage that the coolant is kept in the area of the fire deck 13, i.e. where effective cooling is required.

Figure 10:
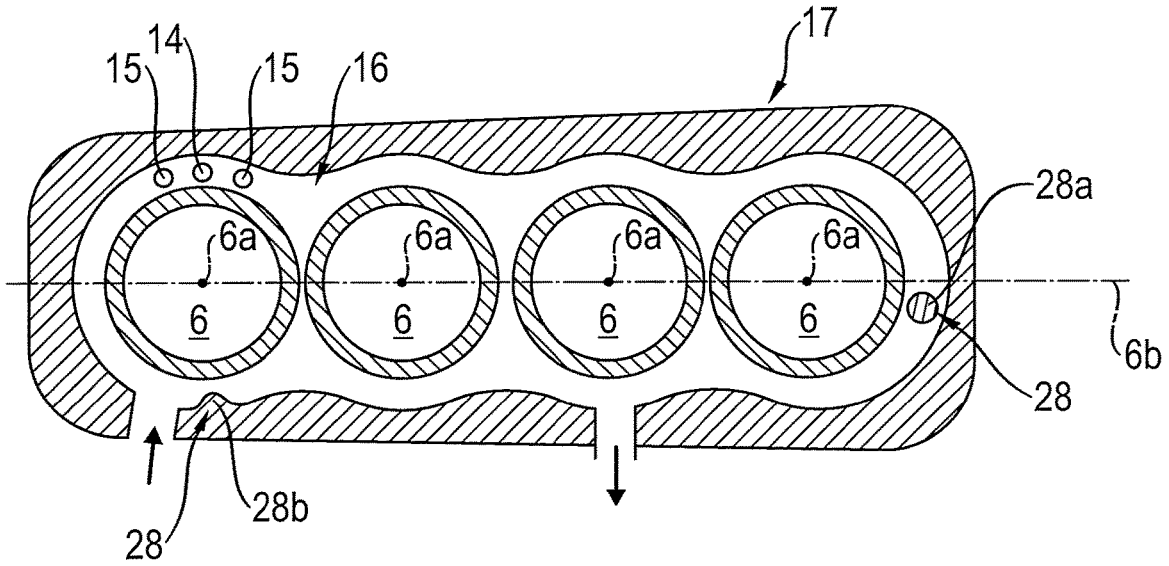
FIG. 10 shows a cylinder block in a section according to the X-X line in FIG. 9.

The cooling jackets 1, 2, 3 are arranged above the cooling chambers 16 of the cylinder block 17. In order to specify a flow direction in the cooling chambers 16 of the cylinder block 17 and thus subsequently the inlet conditions (in particular location and flow velocity) in the first cooling jacket 1 and second cooling jacket 2 and subsequently also the outlet conditions in the cooling chambers 16 of the cylinder block 17, at least one limiting element 28 or a plurality of limiting elements 28 is arranged in the region—in particular in the cooling chambers 16 of the cylinder block 17—of at least one first 14 and/or second inlet opening 15 of the fire deck 13 and/or in the region of at least one outlet opening 25, 26 of the cylinder head 5 (FIG. 10). The limiting elements 28 are cross-sectional constrictions with a defined flow cross-section that reduce the flow cross-section. The limiting elements 28 can, for example, be formed by inserts 28*a* or indentations 28*b* of the walls in the respective coolant flow paths. In particular, the limiting elements 28 may be located in the cold rooms 16 of the cylinder block 17 and/or in the area of the first inlet opening 14 and/or second inlet opening 15 of the fire deck 13 and/or in the area of an outlet opening 25, 26. In FIG. 10 the approximate positions of the first and second inlet openings of the first 1 and second cooling chambers of the cylinder head 5 are indicated for the first cylinder 6 with reference numerals 14, 15.

The first coolant jacket 1 and the second coolant jacket 2 are separately flowed into from the cooling chamber 16 of the cylinder block 17.

All cooling jackets 1, 2, 3 are mainly designed as channels in which the liquid coolant is fed and free of large cavities. In order to keep the pressure loss in the overall system small or to avoid it, the channels of the cooling jackets 1, 2, 3 are designed with different cross-sections.

The two lower cooling jackets 1, 2 can be produced as a common sand core due to their design and shape. This makes the three-part cooling jacket arrangement 4 easy to produce.

In order to keep the required coolant quantity low and to achieve small flow cross-sections with high coolant speeds, first coolant jacket 1, second coolant jacket 2 and/or third coolant jacket 3 have recesses 31, 32, 33 which are formed by material accumulations in the cylinder head 5.

The cooling jacket arrangement 4 according to the invention is not limited to the embodiment described and shown in FIG. 1 to FIG. 10. It can easily be adapted to a different number of cylinders or a different geometry of the integrated exhaust manifold 7. Special features are the three-part design, the separate inflow of the first 1 and the second cooling jacket 2, as well as the sole cross-flow of the coolant in the cooling jackets 1, 2, 3, which is essentially normal to the longitudinal central plane 6*b*.

The invention claimed is:

1. A cylinder head for an internal combustion engine, the cylinder head comprising:

at least one cylinder; and a cooling jacket arrangement with a first cooling jacket arranged in the region of a longitudinal central plane of the cylinder head, and the first cooling jacket is configured and arranged to be flow-connected to the cooling chamber of a cylinder block via at least one first inlet opening, a second cooling jacket facing a fire deck of the cylinder head, and adjoins an underside of an exhaust manifold integrated into the cylinder head on an outlet side, and the second cooling jacket is configured and arranged to be flow-connectable via at least one second inlet opening in the fire deck to at least one cooling chamber of the cylinder block connectable to the cylinder head, and a third continuous cooling jacket facing away from the fire deck, and is adjacent to an upper side of the exhaust manifold;

wherein the first cooling jacket is further configured and arranged to be directly flow-connected to the third cooling jacket via at least one first transfer section and the section cooling jacket is further configured and arranged to be directly flow-connected to the third cooling jacket via at least one second transfer section; and the third cooling jacket is configured and arranged to be flow-connectable to the cooling chamber of the cylinder block via at least one outlet opening arranged on the inlet side of the cylinder head.

2. The cylinder head according to claim 1, characterized in that the first inlet opening and/or the second inlet opening are arranged on the outlet side of the cylinder head.

3. The cylinder head according to claim 1, characterized in that the third cooling jacket is separated from the first and the second cooling jackets by an intermediate deck.

4. The cylinder head according to claim 1, characterized in that the first cooling jacket is configured and arranged to be flow-connectable to the cooling chamber of the cylinder block via at least one outlet opening arranged on the inlet side of the cylinder head.

5. The cylinder head according to claim 1, characterized in that the third cooling jacket is configured and arranged to be flow-connectable to a vehicle heater via at least one transfer section opening.

6. The cylinder head according to claim 1, characterized in that the third cooling jacket extends from an outlet side of the cylinder head in the direction of an inlet side of the cylinder head up to at least one intermediate cylinder region.

7. The cylinder head according to claim 1, characterized in that the first cooling jacket has, in at least one central region of at least one cylinder, a channel ring arranged concentrically relative to its cylinder axis.

8. The cylinder head according to claim 1, characterized in that the first cooling jacket has at least one radial channel and/or a channel bridge adjoining at least one exhaust valve seat region.

9. The cylinder head according to claim 1, characterized in that the second cooling jacket extends from an edge region of the cylinder into an outlet flange region of the cylinder head.

10. The cylinder head according to claim 1, characterized in that the at least one first and/or the at least one second transfer section is configured and arranged to be formed by a bore with a defined diameter.

11. The cylinder head according to claim 1, characterized in that at least one limiting element is arranged in the region of at least one first and/or second inlet opening of the fire deck and/or in the region of at least one outlet opening.

12. The cylinder head according to claim 1, characterized in that at least two of the first, second and third cooling jackets have different flow cross-sections.

13. The cylinder head according to claim 1, characterized in that the first and the second cooling chamber are formed by a common integral casting core.

14. An internal combustion engine comprising:

a cylinder head; and a cooling jacket arrangement with a first cooling jacket arranged in the region of a longitudinal central plane of the cylinder head, and is configured and arranged to be flow-connected to the cooling chamber of a cylinder block via at least one first inlet opening, a second cooling jacket facing a fire deck of the cylinder head, and adjoins an underside of an exhaust manifold integrated into the cylinder head on an outlet side, and the second cooling jacket is configured and arranged to be flow-connectable via at least one second inlet opening in the fire deck to at least one cooling chamber of the cylinder connectable to the cylinder head, and a third continuous cooling jacket facing away from the fire deck, and is adjacent to an upper side of the exhaust manifold, the third cooling jacket is configured and arranged to be flow-connectable to the cooling chamber of the cylinder block via at least one outlet opening arranged on the inlet side of the cylinder head;

wherein the first cooling jacket is further configured and arranged to be directly flow-connected to the third cooling jacket.

15. The internal combustion engine of claim 14, wherein the first cooling jacket is further configured and arranged to be directly flow-connected to the third cooling jacket via at least one first transfer section and the second cooling jacket is further configured and arranged to be flow-connected to the third cooling jacket via at least one second transfer section.

16. The internal combustion engine of claim 14, characterized in that the first inlet opening and/or the second inlet opening are arranged on the outlet side of the cylinder head.

17. The internal combustion engine of claim 14, characterized in that the third cooling jacket is separated from the first and the second cooling jackets by an intermediate deck.

18. The internal combustion engine of claim 14, characterized in that the first cooling jacket is configured and arranged to be flow-connectable to the cooling chamber of the cylinder block via at least one outlet opening arranged on the inlet side of the cylinder head.

19. The cylinder head of claim 8, wherein the radial channel or the channel bridge originate from a channel ring arranged in at least one central region of a cylinder.

* * * * *